US006731772B1

(12) United States Patent
Byun

(10) Patent No.: US 6,731,772 B1
(45) Date of Patent: May 4, 2004

(54) CUSHION COVER FOR PREVENTING PAINS IN USING EARPHONES

(75) Inventor: Ki-Man Byun, Seoul (KR)

(73) Assignee: Splendor Co., Ltd., Seoul (KR)

( * ) Notice: Subject to any disclaimer, the term of this patent is extended or adjusted under 35 U.S.C. 154(b) by 0 days.

(21) Appl. No.: 09/555,997

(22) PCT Filed: Dec. 5, 1998

(86) PCT No.: PCT/KR98/00408

§ 371 (c)(1),
(2), (4) Date: Jun. 7, 2000

(87) PCT Pub. No.: WO99/30531

PCT Pub. Date: Jun. 17, 1999

(30) Foreign Application Priority Data

Dec. 9, 1997 (KR) ..... 1997-36650
Nov. 24, 1998 (KR) ..... 1998-23262

(51) Int. Cl.[7] ..... H04R 25/00

(52) U.S. Cl. ..... 381/380; 181/130

(58) Field of Search ..... 381/380, 385, 381/383, FOR 149, FOR 150; 181/130, 135, 129, 131, 132, 133, 134

(56) References Cited

U.S. PATENT DOCUMENTS

| | | | | | |
|---|---|---|---|---|---|
| 3,030,458 | A | * | 4/1962 | Gongoll | 381/371 |
| 4,133,984 | A | * | 1/1979 | Akiyama | 381/328 |
| 4,403,120 | A | | 9/1983 | Yoshimi | |
| 4,443,668 | A | | 4/1984 | Warren | |
| 4,668,842 | A | | 5/1987 | Yokoyama et al. | |
| 4,965,838 | A | * | 10/1990 | Kamon et al. | 381/187 |
| 5,048,092 | A | * | 9/1991 | Yamagishi et al. | 181/135 |
| 5,654,530 | A | * | 8/1997 | Sauer et al. | 181/130 |

* cited by examiner

*Primary Examiner*—Curtis Kuntz
*Assistant Examiner*—Brian Ensey
(74) *Attorney, Agent, or Firm*—Renner, Otto, Boisselle & Sklar, LLP

(57) ABSTRACT

The prevent invention is related to a cushion cover to improve adherence and to prevent pains when wearing earphones which deliver sounds of various portable small-sized recorders, radios, etc. by inserting them into earholes inside of earflaps for a long time. The cushion cover which covers the circumference of the insertion portion of earphones in the present invention is composed of the fixing-in portion which is grounded to the above insertion portion, the ear connection portion which is grounded to the inner earflaps, and the air chamber which absorbs the pressure added to the fixing-in portion and connection portion in order to soften adherence to earholes.

9 Claims, 3 Drawing Sheets

CUSHION COVER FOR PREVENTING PAINS IN USING EARPHONES

TECHNICAL FIELD

The present invention relates, in general, to a cushion cover for earphones of various portable small-sized recorders, radios, etc. designed to allow such earphones to better fit more comfortably in the ear without pain.

BACKGROUND ART

When earphones are inserted in the ear, generally the circumference of the insertion portion of the earphones contacts the concha of the ear for holding the earphone in the ear. Long-time use of earphones sometimes has caused problems of pain or discomfort due to continuous added pressure and friction of the insertion portion with the ear. Also, the earphone may fail to block external noise due to a poor fit. Further, repetitive long-time uses of earphones have caused diseases including skin disease, tympanitis, etc., and have led to hearing defects. There have been other disadvantages arising from long-time wearing of earphones.

In order to relieve the above-mentioned pain the circumference of the insertion portion of earphones has been covered with a cushion cover made of foam sponge or rubber material. However, such conventional covers have been inferior due to inherent characteristics and deformation of the materials from which the covers have been made.

DISCLOSURE OF INVENTION

It is therefore an object of the present invention to resolve problems of conventional cushion covers of earphones by providing a ring-shaped cover that surrounds the circumference of the insertion portion of an earphone, is made of a soft resin and is provided with air chambers to double the cushion effect of the cover.

BRIEF DESCRIPTION OF DRAWINGS

The foregoing and other objects, aspects, and advantages will be better understood from the following detailed description of preferred embodiments of the invention with reference to the drawings, in which.

BEST MODE FOR CARRYING OUT THE INVENTION

Figure 1:
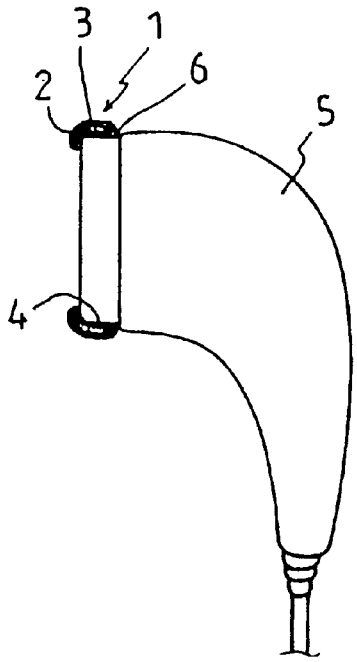
FIG. 1 is a sectional view of a cushion cover fitted on an earphone according to a first embodiment of the present invention.
Figure 2:
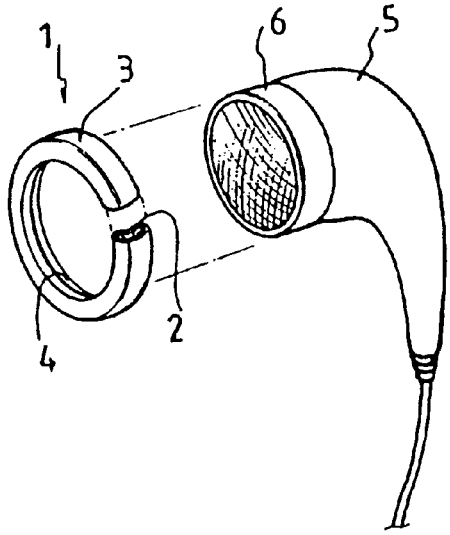
FIG. 2 is a perspective view of the cover of FIG. 1, shown separated from the earphone.

Referring now to the drawings, and more particularly to FIGS. 1 and 2, there is shown a cushion cover 1 fitted on an earphone 5 according to the present invention. The cushion cover 1 is connected to the circumference of the insertion portion 6 of the earphone 5. The present invention is characterized by an annular earphone fitting portion 4 which is fitted over the insertion portion 6, an ear connection portion 3 which fits in the ear, and an air chamber 2 which is defined by the fitting portion 4 and the ear connection portion 3 and which absorbs pressure applied to the earphone fitting portion 4 and ear connection portion 3.

The cushion cover 1 is made of a highly elastic soft resin material and surrounds the circumference of the insertion portion 6 of the earphone 5.

To use the cushion cover, one end of the earphone fitting portion 4 is fitted over the insertion portion 6 and held while another end of the earphone fitting portion 4 is pulled to cover the insertion portion 6 of the earphone 5. When not installed on the earphone the diameter of the cushion cover 1 is a little smaller than that of the insertion portion 6 of the earphone 5 so that the earphone fitting portion 4 will be, when installed, closely held to the insertion portion 6 by the inherent elasticity of the cushion cover 1.

With the cushion cover installed on the earphone, the earphone may be inserted into an ear with the ear connection portion 3 safely engaging the inner surface of the ear. Any force arrising from movement of the earphone 5 as the wearer moves around is absorbed and relieved by a cushion action of the air chamber 2, and therefore, direct stimulation or pain of the ear does not occur. Particularly, the air chamber avoids non-homogeneity while wearing as the touch is very soft and a tight fit is provided, and further it is possible to maintain superior tone quality as external noises are cut off effectively. The cover of the present invention may be assembled on the circumference of various-shaped insertion portions since the cushion cover 1 is variable by reason of its elasticity, even for an earphone whose circumference of the insertion point is oval or arced.

Figure 3:
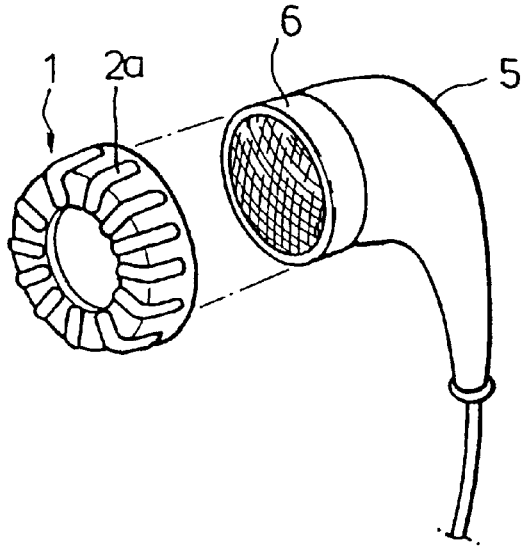
FIG. 3 is a perspective view showing a cushion cover according to a second embodiment of the invention.
Figure 4A:
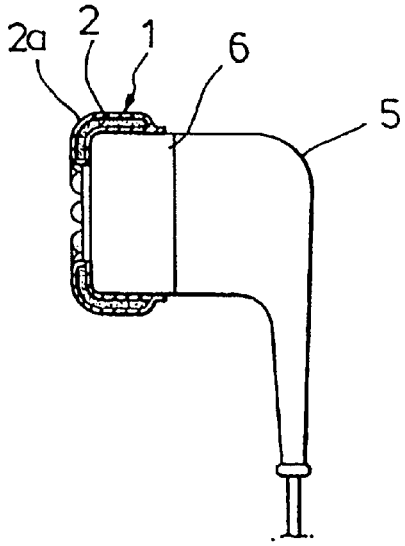
FIG. 4*a* is a cross-sectional view of the cushion cover of FIG. 3, shown fitted on the earphone.
Figure 4B:
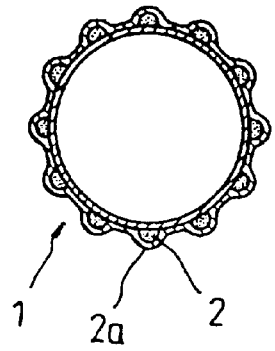
FIG. 4*b* is a transaxial cross-sectional view of the cushion cover of FIG. 3.

FIGS. 3, 4*a*, and 4*b* are related to the second embodiment of the present invention. An air pocket 2*a* is formed radially around the cushion cover 1 so that the air chamber 2 inside has a cushion characteristic when it is connected to the earhole.

Figure 5:
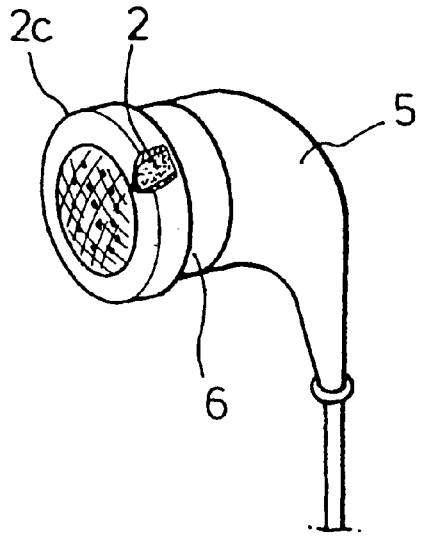
FIG. 5 is a perspective view showing a cushion cover according to a third embodiment of the invention.
Figure 6:
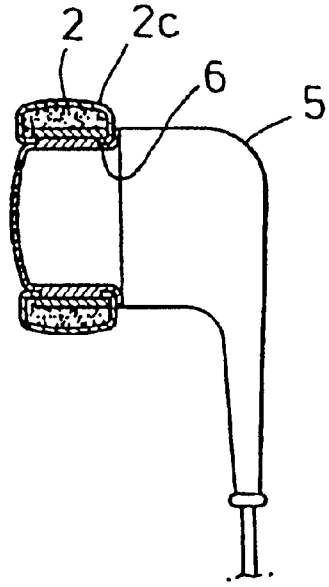
FIG. 6 is a cross-sectional view of the cushion cover of FIG. 5.

FIGS. 5 and 6 show the third embodiment of the present invention. A round air tube 2*c* is fixedly attached to the insertion portion 6 of the earphone 5 so that the annular air chamber 2 has a cushion property as the air chamber 2 is inserted into the earhole.

Also in case of the second and third embodiments, the ear is not stimulated as the air pocket 2*a* and air tube 2*c* are smoothly fitted in an earhole, and high-quality hearing of earphone sound is enabled with external noises cut off since the fit is improved.

INDUSTRIAL APPLICABILITY

As illustrated in the above, the present invention is very practical and useful in that no non-homogeneity is felt although earphones are worn for a long time since the air chamber formed in the cover of the earphone softens the touch and improves adherence when wearing; generation of diseases due to skin contact can be effectively prevented since the cover in the present invention does not stimulate earholes; and hearing of high-quality sounds is enabled as noises delivered externally are cut off remarkably.

While the invention has been described in terms of a few preferred embodiments, those skilled in the art will recognize that the invention can be practiced with modification within the spirit and scope of the appended claims.

What is claimed is:

1. A cushion cover for an earphone for preventing pains in wearing, which includes a radially inner annular earphone fitting portion for connecting to an earphone and a radially outer ear connection portion sized for insertion in a human ear, characterized by an air chamber formed between said earphone fitting portion and ear connection portion of said cushion cover to give a cushion effect, and said earphone fitting portion being made of an elastic material, and said cushion cover being round with a diametrical width greater than its axial length.

2. A cushion cover for an earphone for preventing pains in wearing, which includes a radially inner annular earphone fitting portion for connecting to an earphone and a radially outer ear connection portion, characterized by an air chamber formed between said earphone fitting portion and ear connection portion of said cushion cover to give a cushion effect, and said earphone fitting portion being made of an elastic material, and wherein said air chamber is formed by a circumferential arrangement of radial air pockets.

3. A cushion cover as set forth in claim 1, wherein said air chamber is formed in the form of an enclosed tube in said cushion cover.

4. A cushion cover as set forth in claim 1, wherein the air chamber has an annular shape and is enclosed by the the earphone fitting portion and the ear connecting portion.

5. A cushion cover as set forth in claim 1, made of an elastic material.

6. A cushion cover as set forth in claim 1, wherein the earphone fitting portion and the ear connecting portion are made of an elastic material.

7. A cushion cover as set forth in claim 1, wherein the air chamber has an annular shape and is closed to the interior of the cushion.

8. A cushion cover as set forth in claim 1, assembled on an earphone.

9. A cushion cover for an earphone for preventing pains in wearing, which includes a radially inner annular earphone fitting portion for connecting to an earphone and a radially outer ear connection portion sized for insertion in a human ear, characterized by an air chamber formed between said earphone fitting portion and ear connection portion of said cushion cover to give a cushion effect, and said earphone fitting portion being made of an elastic material, and wherein there is no provision for user inflation of the air chamber.

* * * * *